United States Patent [19]

Deutsch

[11] 4,114,496

[45] Sep. 19, 1978

[54] NOTE FREQUENCY GENERATOR FOR A POLYPHONIC TONE SYNTHESIZER

[75] Inventor: Ralph Deutsch, Sherman Oaks, Calif.

[73] Assignee: Kawai Musical Instrument Mfg. Co., Ltd., Hamamatsu, Japan

[21] Appl. No.: 758,010

[22] Filed: Jan. 10, 1977

[51] Int. Cl.[2] ..... G10H 1/02; G10H 5/02

[52] U.S. Cl. ..... 84/1.1; 84/1.27

[58] Field of Search ..... 84/1.01, 1.03, 1.09, 84/1.1, 1.27

[56] References Cited

U.S. PATENT DOCUMENTS

| | | | |
|---|---|---|---|
| 3,610,799 | 10/1971 | Watson | 84/1.01 |
| 3,743,755 | 7/1973 | Watson | 84/1.01 |
| 3,821,714 | 6/1974 | Tomisawa et al. | 84/1.01 X |
| 3,823,390 | 7/1974 | Tomisawa et al. | 84/1.01 X |
| 3,882,751 | 5/1975 | Tomisawa et al. | 84/1.01 |
| 3,903,775 | 9/1975 | Kondo et al. | 84/1.01 |
| 3,908,504 | 9/1975 | Deutsch | 84/1.27 X |
| 4,000,675 | 1/1977 | Futamese et al. | 84/1.01 |
| 4,026,179 | 5/1977 | Futamese | 84/1.01 X |

*Primary Examiner*—Stanley J. Witkowski
*Attorney, Agent, or Firm*—Christie, Parker & Hale

[57] ABSTRACT

A frequency generator for a keyboard operated electronic music instrument using a single master clock source for selectively producing all the notes of the musical scale. A set of frequency numbers corresponding to each of the notes of a diatonic scale are stored in a memory. A frequency number is selected from the stored numbers according to the note to be generated when a key on a keyboard is activated, the selected number being applied to an adder-accumulator periodically at the master clock rate for incrementing the contents of the accumulator. Overflow pulses from the adder-accumulator shift amplitude values sequentially from a set of values stored in a shift register through an adder to a digital-to-analog converter. The adder modifies the amplitude values by applying a fractional part of the incremental difference between each value and the next value in the sequence to the adder. The fractional amount is determined by the content of the adder-accumulator and changes with each master clock pulse.

7 Claims, 2 Drawing Figures

NOTE FREQUENCY GENERATOR FOR A POLYPHONIC TONE SYNTHESIZER

FIELD OF THE INVENTION

This invention relates to electronic digital tone synthesizers and more particularly to apparatus for generating all of the notes of a scale from a single master-clock source.

BACKGROUND

Keyboard-operated electronic instruments of the digital tone synthesizer type are well-known. In the co-pending application U.S. Ser. No. 603,776, filed Aug. 11, 1975, entitled POLYPHONIC TONE SYNTHESIZER and now U.S. Pat. No. 4,085,644 there is described a keyboard instrument in which a plurality of tone generators are provided, each tone generator generating a musical tone from a master data list. The data list represents the amplitude values of equally spaced points along an analog signal corresponding to one cycle of the musical tone to be generated. The master data list for each tone generator is stored in a shift register, and the amplitude values are shifted out of the register to a digital-to-analog converter at a shift frequency which is directly proportional to the fundamental frequency of the note being generated.

As described in the above-identified co-pending application, the shift frequency is derived from a variable frequency oscillator. The frequency of the oscillator is controlled by depressing a key on the keyboard. An assignor circuit stores the note identification in a memory and assigns a tone generator to that particular key. The note identification operates as an address of a memory storing separately addressable frequency control numbers.

The frequency of the oscillator is set according to the frequency number read out of the memory in response to the particular key on the keyboard which is despressed. Each tone generator in the instrument has its own oscillator. This permits a number of notes to be generated at the same time, each at a different pitch or frequency, as in sounding a chord. The manner in which the multiple oscillators are controlled is described in more detail in the co-pending application U.S. Ser. No. 634,533 filed Nov. 24, 1975, entitled FREQUENCY NUMBER CONTROL CLOCK, now issued as U.S. Pat. No. 4,067,254. The manner in which the keys in the keyboard are assigned to the tone generators is described in more detail in the co-pending application U.S. Ser. No. 619,615 filed Oct. 6, 1975 entitled KEYBOARD SWITCH DETECT AND ASSIGNOR, now issued as U.S. Pat. No. 4,022,098.

One problem in the use of a plurality of variable frequency oscillators is that of maintaining the instrument in properly tuned condition. Each oscillator must accurately reproduce the frequency of each and every note in the diatonic scale or some integral multiple thereof. However, variable frequency oscillators tend to drift in frequency with time. Also, changes in ambient conditions can affect their frequency. The oscillators must be adjusted so that each key on the keyboard will set any assigned oscillator to the same nominal frequency. Otherwise the pitch of a note will vary depending on which tone generator is assigned to the particular key. This requires extremely stable oscillators that can be accurately set to oscillate over a very wide frequency range. These conditions are a bit difficult to achieve at reasonable cost.

For this reason it would be desirable to generate the pulse trains for shifting the shift registers of the respective tone generator from a single master clock pulse source. One method heretofore proposed for synthesizing clock pulse trains at the musical frequencies is to employ what is called a "top octave synthesizer" having a set of integer counters, one counter for each of the 12 notes in the octave scale. These counters produce an integer division of a single master clock. To produce clock trains corresponding to the frequencies in the top octave requires a master clock rate of approximately 2 megahertz. However, in the polyphonic tone synthesizer described in the above-identified co-pending application U.S. Ser. No. 603,776, now U.S. Pat. No. 4,085,644, the shift pulse frequency must be 64 times the frequency of the note being generated. This would require a master clock frequency which is far too high for the present state of the art.

An alternative technique for obtaining a plurality of frequencies by frequency division from a common clock source is to use a non-integer divider. However, non-integer dividers, while producing pulse trains of any desired average frequency, generate pulse trains in which the intervals between pulses are not always identical. The number of pulses occurring over a given period of time is varied by eliminating pulses at selected pulse intervals from the pulse train. However, if a non-integer divider were used to generate the shift pulse trains in tone generators in a polyphonic tone synthesizer of the type described in the above-identified application U.S. Ser. No. 603,776, now U.S. Pat. No. 4,085,644, the unequal spacing of the pulses in the pulse train would introduce a highly objectionable noise into the system. This noise would be in the form of audible higher frequency components which, because of their wide separation from the fundamental frequency and high level of intensity, would produce displeasing tonal effects.

SUMMARY OF THE INVENTION

The present invention is directed to an arrangement for a non-integer divider for synthesizing clock pulse trains at the musical frequencies which can be utilized in a polyphonic tone synthesizer of the type described in the above-described U.S. patents. The undesired noise effects described above are eliminated or greatly minimized. Thus, the present invention permits a tone generator to generate all the notes of the scale using a single clock source whose frequency is substantially no higher than the highest frequency at which the variable frequency oscillators described in the U.S. patents were required to operate.

In brief, this is accomplished by providing a non-integer divider in the form of a modulo one adder-accumulator that is incremented periodically at the master clock rate by an amount determined by a frequency number selected from a stored frequency number list. The list comprises the binary numbers corresponding to the ratios of the frequency of each note of the keyboard to the frequency of the next highest note of the diatonic scale above the highest note on the keyboard. Thus the ratios are all less than one in value. The accumulator-adder produces an overflow pulse whenever the sum exceeds the capacity of the accumulation, i.e., when the sum reaches a value of one. The overflow pulses shift successive data words from a register storing a master data list of amplitude value for the tone being generated, the words being transfered from the register to the input of a digital-to-analog converter. The shift rate determines the pitch of the tone generated by the analog signal from the converter. To compensate for noise introduced by the irregular pattern of pulses from the non-integer divider, the difference in amplitude between the amplitude values of successive data words in the master list is generated as each word is shifted out of the register. The difference information is applied to a fractional scaler circuit and is scaled by a fractional amount, then added to the output of the first register, the scale factor being controlled by the highest order bits in the adder-accumulator. For example, using the two highest ratio bits, the scale factor applied are 0, $\frac{1}{4}$, $\frac{1}{2}$ and $\frac{3}{4}$.

DESCRIPTION OF THE DRAWINGS

For a better understanding of the invention, reference should be made to the accompanying drawing wherein.

DETAIL DESCRIPTION

Figure 1:
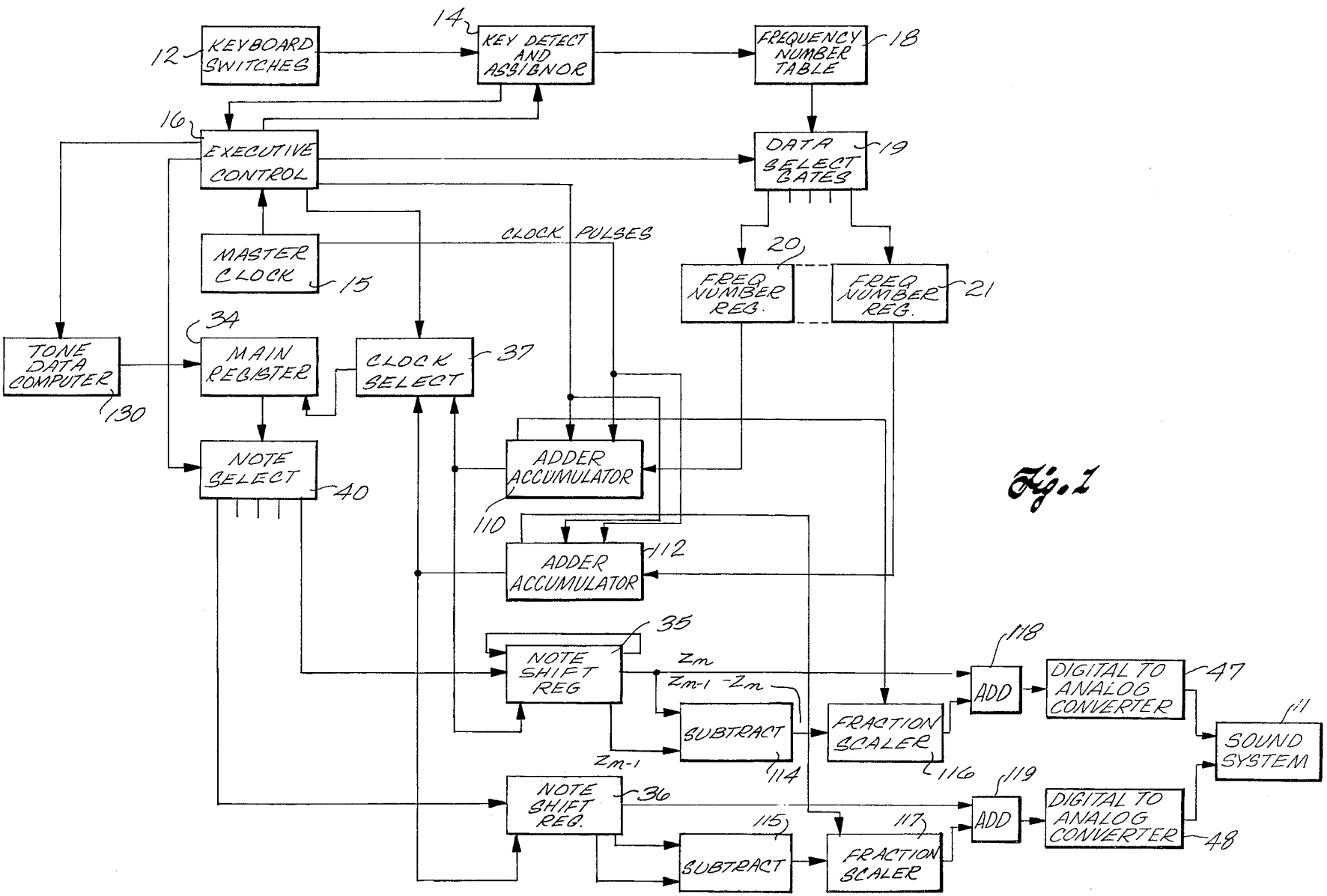
FIG. 1 is a schematic block diagram of the preferred embodiment of the invention.

The present invention is directed to an improvement in the note clock generating system for a polyphonic tone synthesizer of the type described in detail in the three above-identified U.S. patents which are hereby incorporated by reference. In the following description, all portions of the system which have been described in the above applications are identified by two-digit reference numbers which correspond to the numbers used in the above-identified applications for the same circuit elements. All blocks represented by three-digit reference characters correspond to circuits added to the synthesizer to implement the improvement of the present invention.

Referring to FIG. 1 in detail, the numeral 11 indicates generally an audio sound system capable of receiving and mixing up to twelve separate audio voltage signals. Each input signal to the sound system is generated by its own tone generator in response to the operation of a key on a conventional musical keyboard. The keys operate a corresponding number of keyboard switches 12. Up to twelve keys may be operated simultaneously to generate as many as twelve different tones at a time. It will be understood that a polyphonal system having twelve tones is only given by way of example.

Whenever a key on the keyboard operates a switch, a key detect and assignor circuit 14 stores information as to the particular note on the keyboard and assigns that key to one of the twelve tone generators in the system not currently assigned. The note information and the fact that it has been assigned to a tone generator is stored in a memory (not shown) in the keyboard detect and assignor circuit 14. Operation of the key detect and assignor circuit is described in the above-identified co-pending application U.S. Ser. No. 619,615, now U.S. Pat. No. 4,022,098.

Under control of the sequence logic of the executive control circuit 16, whenever a key is operated, a master data list is calculated and stored in a main shift register 34. The master data list is calculated in a time data computer 130 in a manner specifically described in co-pending application U.S. Ser. No. 603,776, now U.S. Pat. No. 4,085,644. As therein described, the master data list for one tone consists of 64 words, each word representing the amplitude of one point on a single cycle of the audio tone to be generated. Depending upon which tone generator has been selected by the assignor 14, a note select gate 40 in response to the executive control 16 transfers the master data list from the main generator 34 to one of twelve note shift registers, two of which are indicated at 35 and 36.

Once a note shift register of a tone generator is loaded with digitized wave form amplitude data, this data is shifted out of the note shift registers to associated digital-to-analog converters, indicated at 47 and 48, at a shift rate which is fixed by the pitch or fundemental frequency of the musical note being generated in response to the particular key on the keyboard.

One arrangement for generating the note clock information is described in the above-identified co-pending application U.S. Ser. No. 634,533, now U.S. Pat. No. 4,067,254. As therein described, each of the twelve tone generators has its own voltage controlled oscillator. In response to the key detect and assignor circuit 14, a frequency number is selected from a stored list of frequency numbers corresponding to the selected note. This number is converted to a corresponding analog voltage which is applied to the voltage controlled oscillator to set the frequency to correspond to an integral multiple, e.g., 64, of the frequency of the selected musical note. Shift pulses derived from the note clock shift the data out of the note shift register 35 at a corresponding rate. Since the note shift register contains the data for one complete cycle, repeatedly shifting the information out of the note shift register at the controlled rate produces an output voltage from the converter whose amplitude changes in accordance with the master list and at a rate fixed at the rate data is shifted out of the register of the note shift register.

The system has the disadvantage, as discussed above, that it requires up to twelve separate oscillators, each of which must be turned over the full range required by the difference in pitch of the highest and lowest notes of the keyboard. Since any of the tone generators may be assigned to a particular key, the oscillators must be tuned so that the twelve tone generators all produce the same pitch when assigned to the same key. The present invention provides an arrangement by which all of the tone generators are driven from a single clock source, such as the system master clock 15.

As in the arrangement described in the above-identified U.S. patents, after the note information is stored in memory in the key detect and assignor circuit 14, this note information is used as an address to address a frequency number in an addressable memory 18. The addressed frequency number is transferred to one of twelve frequency number registers, two of which are indicated at 20 and 21 by means of data select gates 19 in response to the executive control 16. The registers 20 and 21 provide temporary storage of the respective frequency numbers for each of the switches (individual notes) operated on the keyboard. As keys are released and new keys are operated, the executive control 16 causes new frequency numbers to be placed in the registers 20 or 21.

The frequency table in the memory 18 consists of data words in binary form having the values $2^{-(N/12)}$ where $N$ is equal to 1, 2 . . . , M where M is the number of keys on the musical keyboard. Thus the frequency numbers represent the ratios of fundamental frequencies of the notes in an equal tempered musical scale. The frequency data words contained in the memory 18 are shown in the following table:

TABLE I

| NOTE | FREQ | R | R-BINARY | |
|---|---|---|---|---|
| C7 | 2093.0 | 0.9438743127 | 1 1 1 1 0 0 0 1 | 1 0 1 0 0 0 1 0 |
| B6 | 1975.0 | 0.8908987182 | 1 1 1 0 0 1 0 0 | 0 0 0 1 0 0 1 0 |
| A#6 | 1644.7 | 0.8408964153 | 1 1 0 1 0 1 1 1 | 0 1 0 0 0 1 0 1 |
| A6 | 1760.0 | 0.7937005260 | 1 1 0 0 1 0 1 1 | 0 0 1 1 0 0 0 0 |
| G#6 | 1661.2 | 0.7491535385 | 1 0 1 1 1 1 1 1 | 1 1 0 0 1 0 0 1 |
| G6 | 1568.0 | 0.7071067813 | 1 0 1 1 0 1 0 1 | 0 0 0 0 0 1 0 1 |
| F#6 | 1480.0 | 0.6674199272 | 1 0 1 0 1 0 1 0 | 1 1 0 1 1 1 0 0 |
| F6 | 1396.9 | 0.6299605251 | 1 0 1 0 0 0 0 1 | 0 1 0 0 0 1 0 1 |
| E6 | 1318.5 | 0.5946035577 | 1 0 0 1 1 0 0 0 | 0 0 1 1 1 0 0 0 |
| D#6 | 1244.5 | 0.5612310244 | 1 0 0 0 1 1 1 1 | 1 0 1 0 1 1 0 1 |
| D6 | 1174.7 | 0.5297315474 | 1 0 0 0 0 1 1 1 | 1 0 0 1 1 1 0 0 |
| C#6 | 1108.7 | 0.5000000000 | 1 0 0 0 0 0 0 0 | 0 0 0 0 0 0 0 0 |
| C6 | 1046.5 | 0.4719371584 | 0 1 1 1 1 0 0 0 | 1 1 0 1 0 0 0 1 |
| C3 | 130.8 | 0.0589921415 | 0 0 0 0 1 1 1 1 | 0 0 0 1 1 0 1 1 |
| B2 | 123.5 | 0.0556811698 | 0 0 0 0 1 1 1 0 | 0 1 0 0 0 0 0 1 |
| A#2 | 116.5 | 0.0525560259 | 0 0 0 0 1 1 0 1 | 0 1 1 1 0 1 0 0 |
| A2 | 110.0 | 0.0496062828 | 0 0 0 0 1 1 0 0 | 1 0 1 1 0 0 1 0 |
| G#2 | 103.8 | 0.0468220961 | 0 0 0 0 1 0 1 1 | 1 1 1 1 1 1 0 1 |
| G2 | 98.0 | 0.0441941738 | 0 0 0 0 1 0 1 1 | 0 1 0 1 0 0 0 0 |
| F#2 | 92.5 | 0.0417137454 | 0 0 0 0 1 0 1 0 | 1 0 1 0 1 1 1 0 |
| F2 | 87.3 | 0.0393725328 | 0 0 0 0 1 0 1 0 | 0 0 0 1 0 1 0 0 |
| E2 | 82.4 | 0.0371627223 | 0 0 0 0 1 0 0 1 | 1 0 0 0 0 0 1 1 |
| D#2 | 77.8 | 0.0350769390 | 0 0 0 0 1 0 0 0 | 1 1 1 1 1 0 1 1 |
| D2 | 73.4 | 0.0331082217 | 0 0 0 0 1 0 0 0 | 0 1 1 1 1 0 1 0 |
| C#2 | 69.3 | 0.0312500000 | 0 0 0 0 1 0 0 0 | 0 0 0 0 0 0 0 0 |
| C2 | 63.4 | 0.0294960723 | 0 0 0 0 0 1 1 1 | 1 0 0 0 1 1 0 1 |

The first column of Table I lists some of the notes of the conventional keyboard including all of the sixth octave notes and all of the second octave notes. The second column of the table lists the corresponding fundamental frequency of the musical notes, while the third column lists the ratio of the frequency of each note to that of C# in the seventh octave which, being one note higher than the highest note on the keyboard, is chosen to have the value of 1. The fourth column lists the ratios as a 16 bit binary number. While the binary number for several octaves are listed, only the frequency numbers corresponding to one octave need be actually stored in the memory 18, the number for the other octaves being derived by shifting the binary point one place for each octave change.

A frequency number, when transfered to one of the registers 20 or 21, is used to control the frequency of the shift pulses applied to a corresponding one of the note shift registers using pulses from the master clock source 15. To this end, the number stored in the frequency register 20 is applied to the input of an adder-accumulator 110. The accumulator is of modulo one and has a bit capacity, for example, of 16 bits. When activated by the executive control 16, the adder-accumulator 110 adds the frequency number from the register 20 to the contents of the accumulator with each clock pulse from the master clock source 15. The frequency number, always being a number less than one, increments the accumulator one or more times before the accumulator reaches or exceeds a total equal to or in excess of one. Being of modulo one, the accumulator generates an overflow pulse whenever the addition of the frequency number to the contents of the accumulator causes it to reach or exceed one. The adder-accumulator 110 continues to be incremented by the frequency number until a new key is assigned to the tone generator, and the executive control 16 causes a new frequency number to be transferred to the register 20, at which time the accumulator is cleared and the procedure is repeated with the new frequency number.

The adder-accumulator 110 operates as a non-integer divider for the master clock pulses since it generates an output pulse with each master clock pulse that causes the accumulator to exceed a count of one. Assume for example a clock frequency 0.3 that of the master clock is required. Then at each clock time the value 0.3 is added to the contents of the adder-accumulator 110. At each master clock time, the contents of the adder-accumulator 110 will have the following listed values:

TABLE II

| Clock Pulses | Accumulator |
|---|---|
| 0 | 0 |
| 1 | .3 |
| 2 | .6 |
| 3 | .9 |
| 4 | .2 + overflow |
| 5 | .5 |
| 6 | .8 |
| 7 | .1 + overflow |
| 8 | .4 |
| 9 | .7 |
| 10 | .0 + overflow |
| 11 | .3 |
| 12 | .6 |
| 13 | .9 |
| 14 shift | .2 + overflow |

Since the accumulator is modulo one, an overflow pulse is generated at clock pulses 4, 7, 10, 14, etc. The number of output pulses is therefore three for every ten input pulses. However, the time spacing between the output pulses is not equal. In the example, the time intervals between output pulses corresponding to clock pulses 4, 7 and 10 are equal to three clock pulse intervals, while the time between output pulses 9 and 13 corresponds to four clock pulse intervals.

The output pulses from the adder-accumulator 110 are used to transfer the master list in the main register 34 into the associated note shifter register 35. To this end, the output pulses from the adder-accumulator 110 are applied to the shift input of the main register 34 through a clock select gate 37, under control of the executive control 16. The output pulses from the adder-accumulator 110 are also applied to the shift input of the note shift register 35 so that the two registers are synchronized during the transfer. Once the register 35 is loaded, the data list is continued to be shifted out of the note shift register 35 to the digital-to-analog converter 47 by the output pulses from the adder-accumulator 110. In this manner, the average shift rate of the register 35 is a function of the value of the frequency number selected from the Table I.

In a similar manner the frequency number in the register 21 is applied to an adder-accumulator 112. The output pulses from the adder-accumulator 112 are applied to the note shift register 36.

The system as thus far described, because of the non-integer division by the adder-accumulator, produces a distorted or noisy wave form in the analog signal at the input to the sound system. This "noise" is noticeable and objectionable to the listener because of its high level and separation from the fundamental frequency, particularly for the lower notes. The level of this noise introduced by the non-integer divider is minimized by an interpolation system which modifies the digital information applied to the input of the digital-to-analog converters.

The interpolation system associated with each tone generator includes a digital subtract circuit, such as indicated at 114 and 115, having inputs derived from the first two word positions of the note shift register 35 at the output end of the note shift register 35. Thus, if a data point $Z_n$ is shifted to the output end of the shift register, and applied to one input of the subtract circuit 114, the data value $Z_{n+1}$ of the next adjacent word location in the shift register is applied to the other input of the subtract circuit 114. The subtract circuit generates a digital output corresponding to $Z_{n+1} - Z_n = \Delta Z_n$ i.e., the incremental difference in amplitude of two successive data points of the wave form being generated.

The incremental difference from the output of the subtract circuit 114 is applied to a fraction scaler circuit 116. The fraction scaler 116 multiplies the output of the subtract circuit 114 by 0, $\frac{1}{4}$, $\frac{1}{2}$, or $\frac{3}{4}$. The scale factor is determined by the two highest order bits in the adder accumulator 110. If the decimal equivalent of the highest order digits of the accumulator are less than 0.25, a scale factor of 0 is applied, if the decimal equivalent is between 0.25 and less than 0.5, a scale factor of $\frac{1}{4}$ is applied. If the decimal equivalent of the adder accumulator is 0.5 but less than 0.75, a scale factor of $\frac{1}{2}$ is applied. If the adder accumulator is 0.75 or greater, a scale factor of $\frac{3}{4}$ is applied.

The scale fraction of the incremental difference appearing at the output of the subtract circuit 114 is added to the output of the note shift register 35 in an add circuit 118 and applied to the input of the digital-to-analog converter 47. The resulting wave form in shown in FIG. 2 which is a plot based on the data shown in Table II.

Figure 2:
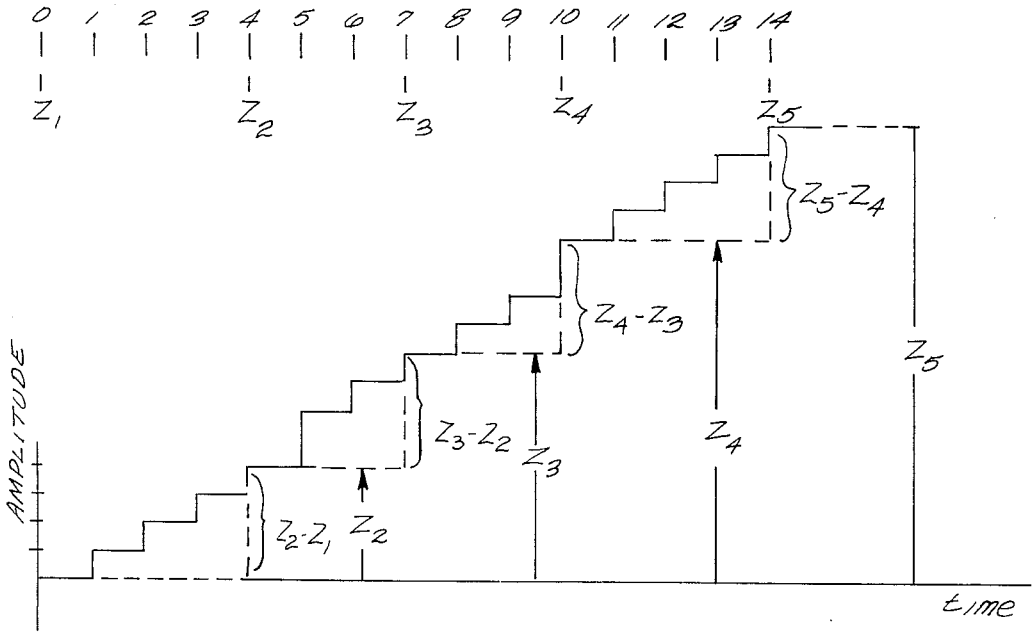
FIG. 2 is a waveform diagram useful in explaining the operation of the invention.

In FIG. 2, the broken line shows a plot of the wave form of the output of the digital-to-analog converter if the output of the shift register 35 was coupled directly to the input of the converter. The solid line shows the wave form at the output of the digital-to-analog converter with the addition of the interpolation provided by the subtract circuit 114, scaler 116, and adder 118. While FIG. 2 shows a step change with each clock pulse, it will be understood that where more than four master clock pulses occur between shift pulses, the scale factor would not be changed with every clock pulse. By providing linear interpolation to the closest $\frac{1}{4}$ interval between data contained in the master data set, the phase error noise created by the unequally spaced pulses generated by the adder accumulator is substantially reduced. While the system as described provides interpolation to the closest $\frac{1}{4}$ interval, smaller fractions for the interpolation can be accomplished by the fraction scaler 116. For example, by using the first three significant bits, the contents of the adder accumulators 110 and 112 on the interpolation could be to the closest $\frac{1}{8}$ interval between data contained in the master data set. However, increasing the number of interpolation intervals does not necessarily improve the performance of the system. In fact, increasing the number of interpolation intervals may increase the phase error noise since each interpolated point of the linear interpolation may not correspond to a true point in the wave shape. The wave shape data in fact is limited in practice to 32 harmonics. An error in the interpolated points implies that the wave shape has 4 (or 8) times the number of points and therefore corresponds to a higher number of harmonics. The interpolated points differ for each successive period of the time series. Because the frequency number is irrational, the "extra" harmonics give rise to noise. The $\frac{1}{4}$ interval interpolation provides a satisfactory compromise.

It should be noted that in some tone generators amplitude changes between data points is available. In such case the $\Delta Z$ values for the waveform may be stored in a separate shift register which is shifted in synchronism with the note register 35 by the overflow pulses from the adder-accumulator 110. The incremental data is shifted out of such register directly to the fraction scaler 116, eliminating the need for the subtract circuit 114.

What is claimed is:

1. Apparatus for generating an audio signal having a waveform determined by a predetermined first set of digitally coded values corresponding to the relative amplitudes of a set of points on one cycle of the waveform and having a fundamental frequency determined by a selected one of a second set of digitally coded values corresponding to the fundamental frequencies of musical notes in a diatonic scale comprising:

a first register storing said first set of values, a digital-to-analog converter, means coupling the digitally coded values shifted out of the register to the converter, a shift pulse source connected to the first register for shifting said stored values from the first register to the converter in timed sequence, said source including an adder-accumulator, means incrementing the adder-accumulator periodically at a fixed clock rate by a selected value from said second set, the accumulator generating an overflow pulse whenever the accumulated value exceeds the capacity of the accumulator, and means connecting the overflow pulses to the first register for shifting the first set of values successively from the register to the converter.

2. The apparatus of claim 1 further including means for generating a digitally coded value equal to the difference between successive values in said first set with each value shifted out of the first register, scaler means for scaling the output from said means for generating a digitally coded value by selected fractional amount including means responsive to the accumulated value in said adder-accumulator for controlling the fractional amount, said means coupling the output of the first register to the converter including means adding the digitally coded output from the scaler means to the output from the first register, the sum value being applied to the converter.

3. Apparatus of claim 2 wherein said fractional amount of the scaler means is $n/4$ wherein $n=0,1,2$, or 3 as set by the adder-accumulator.

4. Apparatus for generating musical notes, comprising means storing a first set of discrete values corresponding to the amplitudes of a set of points defining one cycle of an audio waveform, means storing a second set of discrete values corresponding to the fundamental frequencies of a plurality of musical notes, adder-accumulator means, means periodically transferring a selected value from said means storing a second set of values to the adder-accumulator means for incrementing the content of the adder-accumulator by the amount of said selected value at a predetermined rate, the adder-accumulator generating an output pulse whenever the adder-accumulator exceeds its maximum count condition, an adder having two inputs, one input being connected to said means storing a first set of values, a fractional scaler having two inputs and an output, the output being a fractional amount of the value of a first input as determined by the value of the second input, means coupling the contents of the accumulator-adder to the second input of the scaler to control the scale factor in response to the value in the adder-accumulator, means generating a third set of discrete values corresponding to the incremental change in amplitude between said set of points defining one cycle of said audio waveform, means transferring said third set of values to the first input of the scaler in response to the output pulses of the adder-accumulator, the output of the scaler being connected to the other input of the adder, means sequentially reading out each of the values respectively to the one input of the adder from the means storing said first set of values in response to successive output pulses from the adder-accumulator means.

5. Apparatus of claim 4 further including a digital-to-analog converter connected to the output of the adder for converting the changing output of the adder to an analog voltage.

6. Apparatus of claim 4 wherein said means periodically transferring a selected value includes a keyboard, and means for selecting said selected value in said means storing a second set of values according to which key of the keyboard is operated.

7. Apparatus of claim 4 wherein said fractional scaler includes means setting the scale factor to 0, $\frac{1}{4}$, $\frac{1}{2}$, or $\frac{3}{4}$ of the input value.

* * * * *

UNITED STATES PATENT AND TRADEMARK OFFICE

CERTIFICATE OF CORRECTION

PATENT NO. : 4,114,496

DATED : September 19, 1978

INVENTOR(S) : RALPH DEUTSCH

It is certified that error appears in the above-identified patent and that said Letters Patent are hereby corrected as shown below:

Column 4, line 7, "generator" should read -- register --;

line 39, "turned" should read -- tuned --.

Column 7, line 24, "in" should read -- is --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*